US012459777B2

(12) United States Patent
Yang et al.

(10) Patent No.: US 12,459,777 B2
(45) Date of Patent: Nov. 4, 2025

(54) CABLE COILING DEVICE AND CABLE PROCESSING SYSTEM

(71) Applicant: Tyco Electronics (Shanghai) Co., Ltd., Shanghai (CN)

(72) Inventors: An (Joshua) Yang, Shanghai (CN); Lvhai (Samuel) Hu, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 680 days.

(21) Appl. No.: 17/726,186

(22) Filed: Apr. 21, 2022

(65) Prior Publication Data

US 2022/0340391 A1 Oct. 27, 2022

(30) Foreign Application Priority Data

Apr. 21, 2021 (CN) ..... 202120827134.6

(51) Int. Cl.
*B65H 54/58* (2006.01)
*B65H 54/62* (2006.01)
*B65H 54/74* (2006.01)

(52) U.S. Cl.
CPC ..... *B65H 54/58* (2013.01); *B65H 54/62* (2013.01); *B65H 54/74* (2013.01)

(58) Field of Classification Search
CPC .... B65H 54/58; B65H 54/62; B65H 54/2896; B65H 54/56; B65H 75/28; B65H 65/00
See application file for complete search history.

(56) References Cited

U.S. PATENT DOCUMENTS 3,625,448 A * 12/1971 Griffiths ..... B65H 75/28 242/603
6,357,688 B1 * 3/2002 Backlund ..... B65H 54/2896 226/25
8,079,868 B2 12/2011 Stone et al.
2015/0307313 A1 * 10/2015 Solomon ..... B65H 54/58 53/399

FOREIGN PATENT DOCUMENTS

EP 3020672 A1 * 5/2016 ..... B65H 54/56

OTHER PUBLICATIONS

Examination Report from the European Patent Office dated Apr. 24, 2023, corresponding to Application No. 19 210 069.1-1201, 6 pages.

* cited by examiner

*Primary Examiner* — Anna M Momper
*Assistant Examiner* — Nathaniel L Adams
(74) *Attorney, Agent, or Firm* — Barley Snyder

(57) ABSTRACT

A cable coiling device comprises a cable coiling mechanism adapted to coil a cable to form a cable roll, and a cable clamping mechanism. The cable clamping mechanism clamps and fixes an end segment of the cable during coiling the cable. The end segment has a predetermined length and is adapted to be processed while the cable is coiled.

20 Claims, 10 Drawing Sheets

CABLE COILING DEVICE AND CABLE PROCESSING SYSTEM

CROSS-REFERENCE TO RELATED APPLICATIONS

This application claims the benefit of Chinese Patent Application No. CN202120827134.6 filed on Apr. 21, 2021 in the State Intellectual Property Office of China, the whole disclosure of which is incorporated herein by reference.

FIELD OF THE INVENTION

Embodiments of the present disclosure generally relate to cable processing, and more specifically, to a cable coiling device and a cable processing system utilizing the same.

BACKGROUND

In order to facilitate transportation, storage, operation or management, for example, before wiring or using cables such as optical cables or power cables, or when selling short cables (such as cables of several meters to more than ten meters), it is necessary to cut tens or even hundreds of meters of cable from a reel, coil it into a cable roll, and bundle the cable roll. As a result, in the automatic assembly process of most cable connectors, the time for feeding and coiling the cable is much longer than the time for processing the cable end processing, such as cable peeling and crimping. The longer the cable, the longer the time it takes to coil the cable. In addition, in the prior art, the cable end cannot be processed while coiling the cable, resulting in time-consuming operations and relatively low work efficiency.

SUMMARY

According to an embodiment of the present disclosure, a cable coiling device comprises a cable coiling mechanism adapted to coil a cable to form a cable roll, and a cable clamping mechanism. The cable clamping mechanism clamps and fixes an end segment of the cable during coiling the cable. The end segment has a predetermined length and is adapted to be processed while the cable is coiled.

BRIEF DESCRIPTION OF THE DRAWINGS

The invention will now be described by way of example with reference to the accompanying Figures, of which.

DETAILED DESCRIPTION OF THE EMBODIMENTS

Figure 1:
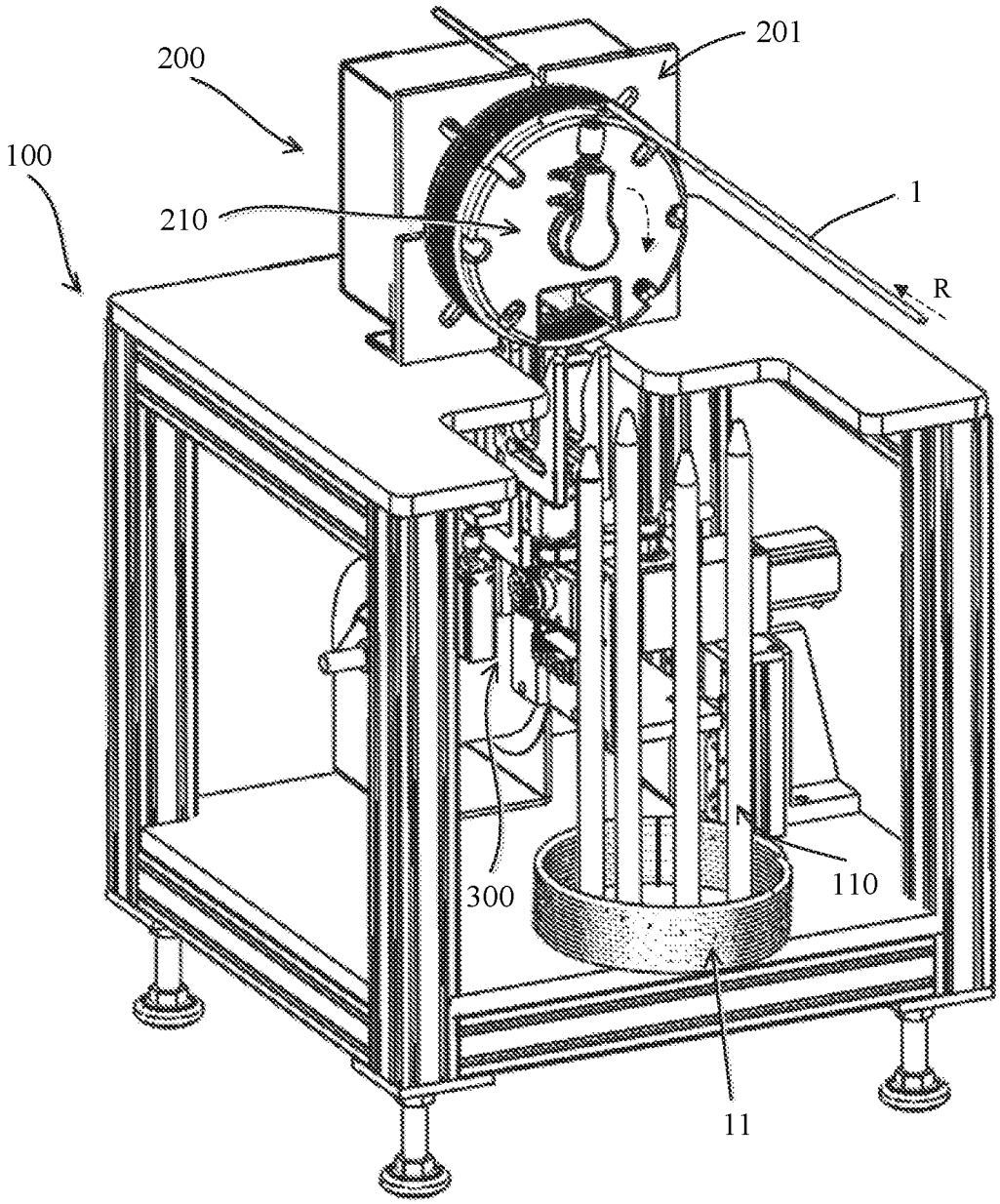
FIG. 1 is a perspective view schematically showing a cable processing system according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a cable coiling device includes a cable coiling mechanism coiling a cable to form a cable roll. A cable clamping mechanism of the device clamps and fixes an end segment of the cable during coiling the cable. The end segment has a predetermined length and is adapted to be processed while the cable is coiled. Thus, by clamping the cable by the cable clamping mechanism, various processing operations can be carried out on the reserved non coiled end segment while the cable is coiled by the cable coiling mechanism, such as but not limited to separating the strand of the smooth cable by the operator or other tools, peeling, spreading the braided wire, crimping electronic components such as terminals on the core wire, etc. This can effectively reduce the cable processing time and improve the work efficiency.

According to another exemplary embodiment of the present disclosure, a cable processing system suitable for performing a variety of processing operations on a cable such as a power cable, an optical cable, etc., including but not limited to cable roll, bundling, etc., is provided. In the illustrated embodiment, the cable processing system includes a support frame 100 and a cable coiling device 200 provided on the support frame 100. The cable coiling device 200 is used to receive the cable 1 supplied along a feeding direction R and coil the cable 1 into a cable roll 11 including multiple turns or multiple turns of cable.

As shown in FIGS. 1-4B, the cable coiling device 200 includes a cable coiling mechanism 210, The front end segment 12 (i.e., an end segment 12 with a predetermined length) of the cable 1 is fed across the cable coiling mechanism 210 along in the feeding direction R and is located outside the cable coiling mechanism 210. The end segment 12 of the cable 1 is not coiled and is to be processed while coiling the cable 1. The subsequently fed part or the remaining part of the cable 1 except for the end segment 12 is coiled on the cable coiling mechanism 210 to form a cable roll 11. The end segment 12 may have a predetermined length to be processed as described below.

According to an embodiment of the present disclosure, the cable coiling device 200 also includes a cable clamping mechanism 230 for clamping the end segment 12 during coiling the cable 1 by the cable coiling mechanism 210, for example, clamping the end segment 12 at a position separated from the cable coiling mechanism 210 so that at least a part of the end segment 12, for example, the part of the end segment 12 located on the side opposite to the cable coiling mechanism 210 of the cable clamping mechanism 230 can be fixed during coiling the cable 1 by the cable coiling mechanism 210.

Thus, while the cable coiling mechanism 210 coils the cable 1, the end segment 12 of the cable 1 is clamped and is not coiled, and therefore, some operation processes can be carried out on the end segment 12. These operations include, but are not limited to, separating the strands of the smooth cable, peeling, spreading the braided wire, crimping electronic components such as terminals on the core wire by an operator or other tools. This can effectively reduce the cable processing time and improve the work efficiency.

The cable coiling device 200 may also include a spacer plate 201, which is fixed on the support frame 100, for example, and the cable clamping mechanism 230 and the cable coiling mechanism 210 are respectively installed on the opposite sides of the partition plate 201. As shown in FIGS. 1-4A, the spacer plate 201 may be provided with an opening or hole 203, so that the end segment 12 of the cable 1 is fed through the opening or hole 203 from one side of the spacer plate 201 (i.e., from the side where the cable coiling mechanism 210 is located) to the opposite side of the spacer plate 201 (i.e., the side where the cable clamping mechanism 230 is located) and held by the cable clamping mechanism 230.

As shown in FIGS. 1 and 3A-4B, the cable coiling mechanism 210 includes a coiling disc 211 and a rolling wheel 212. The coiling disc 211 is fixedly mounted, and the outer circumference of the coiling disc 211 has a width along the feeding direction R. The rolling wheel 212 is configured so that it can rotate relative to the coiling disc 211 along the circumferential direction of the coiling disc 211. The rolling wheel 212 is further adapted to engage the cable 1 during coiling of the cable 1 by the cable coiling mechanism 210, and drive, such as pushing, the cable 1 so that the cable 1 rotates along the circumferential direction of the coiling disc 211 while being fed in the feeding direction R. In this way, the fed cable 1 is continuously coiled on the outer circumference of the coiling disc 211, for example, from a position close to or away from the spacer plate 201, and coiled on the coiling disc 211 turn by turn in the feeding direction R to form the cable roll 11. In this way, the multi cable turns of the cable roll 11 are arranged in the width direction of the coiling disc 211.

The cable clamping mechanism 230 may be fixedly provided with respect to the coiling disc 211. Thus, unlike the way in which the coiling disc rotates to coil the cable in the prior art, according to the cable coiling device of the present disclosure, during the coiling of the cable 1, the coiling disc 211, the cable clamping mechanism 230 and the clamped end segment 12 remain stationary, and the rolling wheel 212 pushes the fed cable 1 to rotate for coiling.

According to an exemplary embodiment, the rolling wheel 212 is installed or positioned to engage or contact with the fed cable 1 with its peripheral surface during the coiling of the cable 1 by the cable coiling mechanism 210, and the rolling wheel 212 can rotate about an axis extending in the radial direction of the coiling disc 211. As a result, the rolling wheel 212 rotates around the axis by engagement with the cable 1 fed in the feeding direction R during cable roll, so as to push the cable 1 to rotate along the circumferential direction of the coiling disc 211 and coil it on the outer circumference of the coiling disc 211.

Figure 3A:
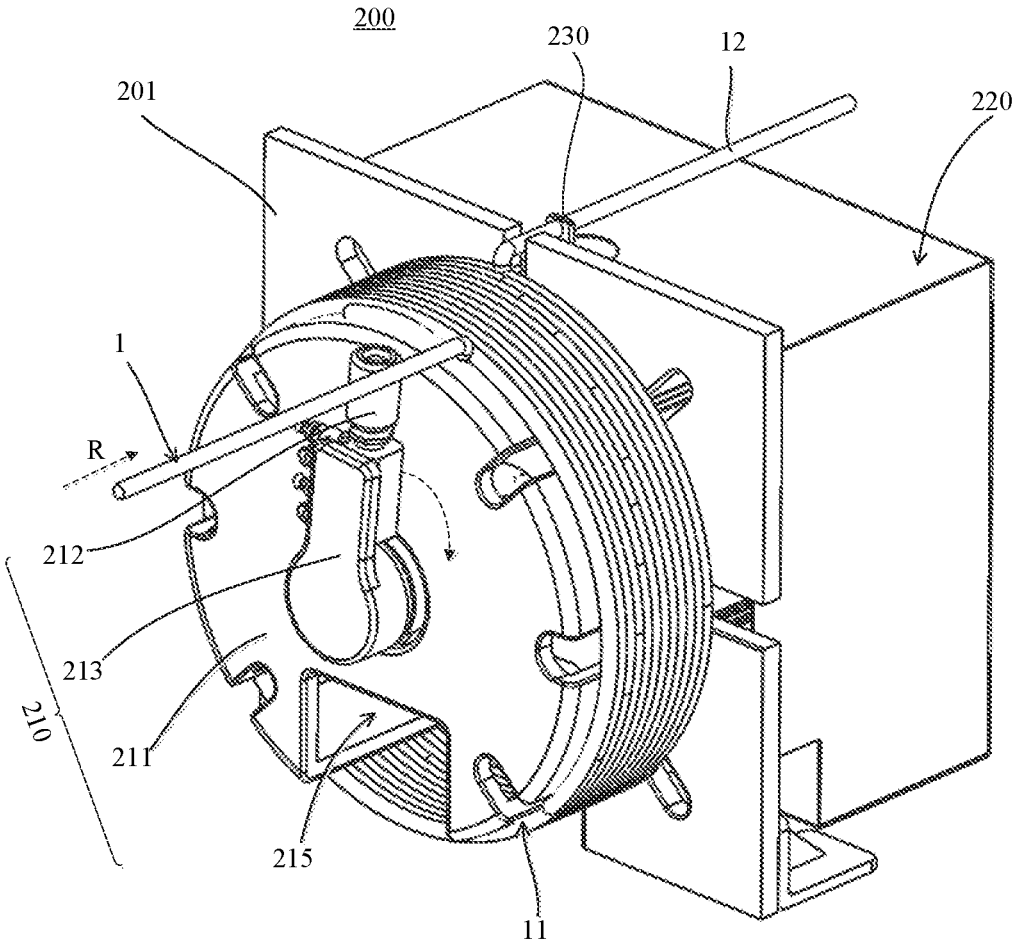
FIGS. 3A to 3C are schematic diagrams respectively showing a cable coiling device according to an exemplary embodiment of the present disclosure.
Figure 3B:
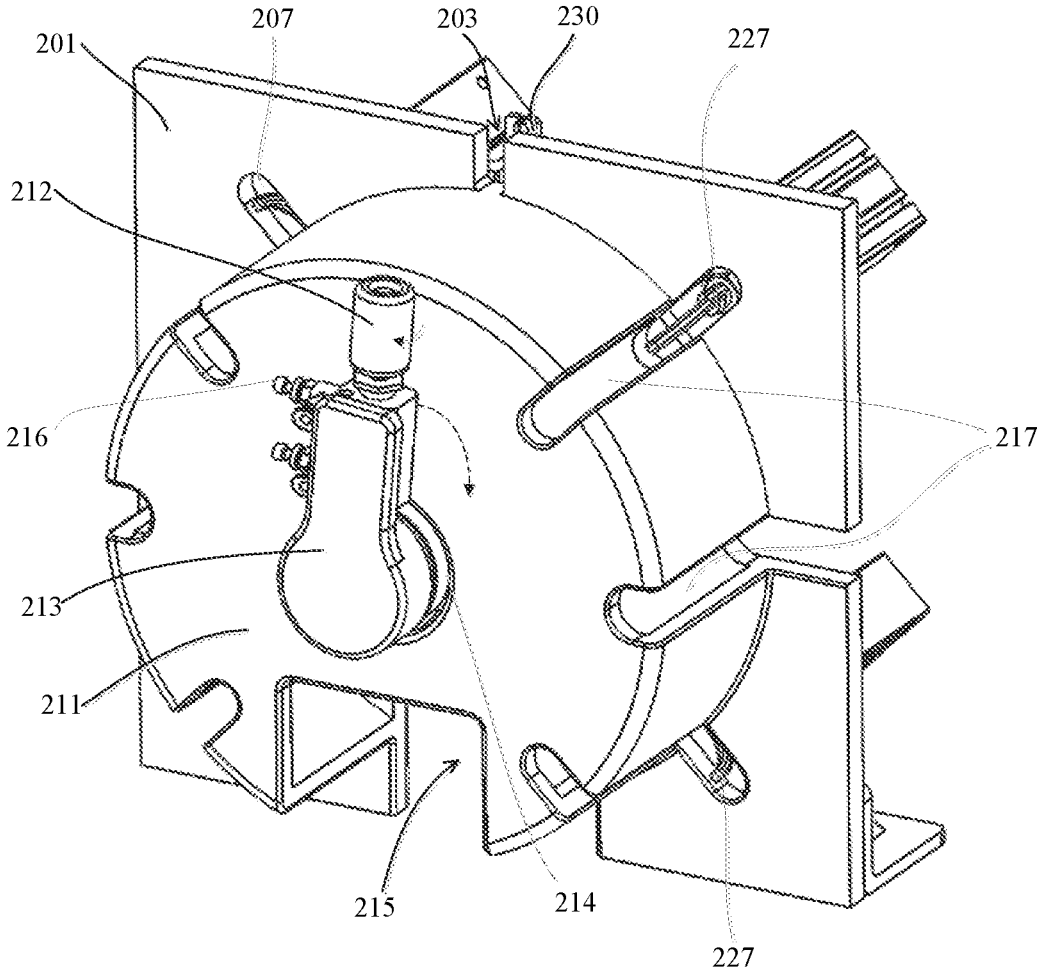
Figure 3C:
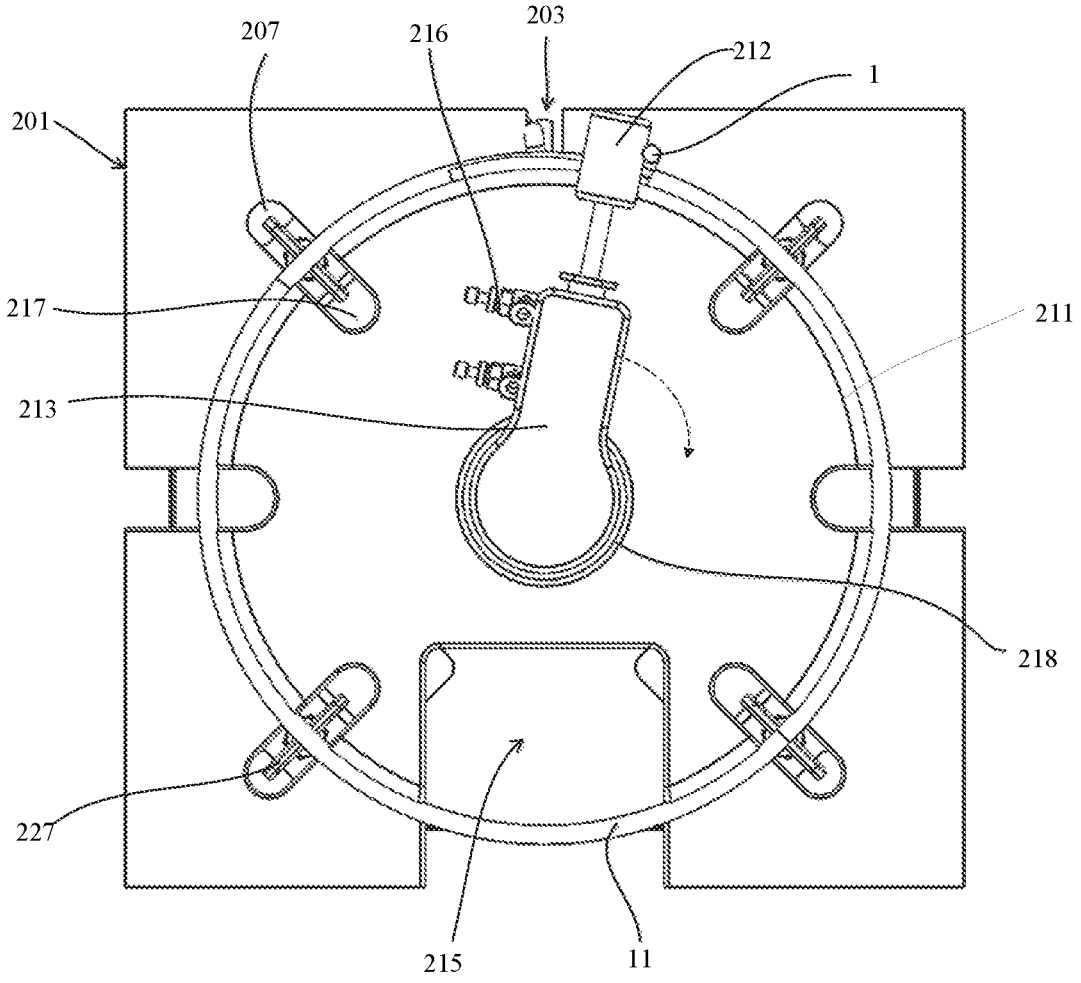

The rolling wheel 212 may be installed, or adapted, to be able to extend out and retract back in the radial direction of the coiling disc 211. The rolling wheel 212 is extended out radially during coiling the cable by the cable coiling mechanism 210 to engage with the cable 1 (as shown in FIG. 3C). The rolling wheel 212 is radially retracted back to a position that does not interfere with the unloading of the cable roll (the retracted position shown in FIGS. 3A and 3B) when the cable roll 11 is unloaded from the coiling reel 211. For example, as shown in the figure, the radial extension or retraction of the rolling wheel 212 can be realized by a driving device 216, such as a telescopic cylinder.

In the illustrated embodiment, the cable coiling mechanism also includes a coiling arm 213, one end of the coiling arm 213 is equipped with the rolling wheel 212, and the opposite end of the coiling arm is connected with a rotating shaft 214 extending through the coiling disc 211 (such as through the central hole 218 of the coiling disc 211) in the feeding direction R. The rotation of the rotating shaft 213 drives the coiling arm 213 and the rolling wheel 212 mounted thereon to rotate relative to the coiling disc 211 along the circumferential direction of the coiling disc 211.

According to the embodiment of the present disclosure, the cable coiling device also includes a driving module 220, which includes at least a driving mechanism for driving the coiling of the cable. As shown in the figure, the driving module 220 can be separated from the cable coiling mechanism 210. For example, it is located on the side opposite to the cable coiling mechanism 210 of the spacer plate 201 and can be fixed on the spacer plate 201. For example, the driving module 220 includes a housing and a first drive mechanism 221 installed in the housing, such as a motor, which is configured to drive the rotation of the rotating shaft 214, so as to drive the coiling arm 213 and the rolling wheel 212 installed thereon to rotate relative to the coiling disc 211 along the circumferential direction of the coiling disc 211.

Figure 4A:
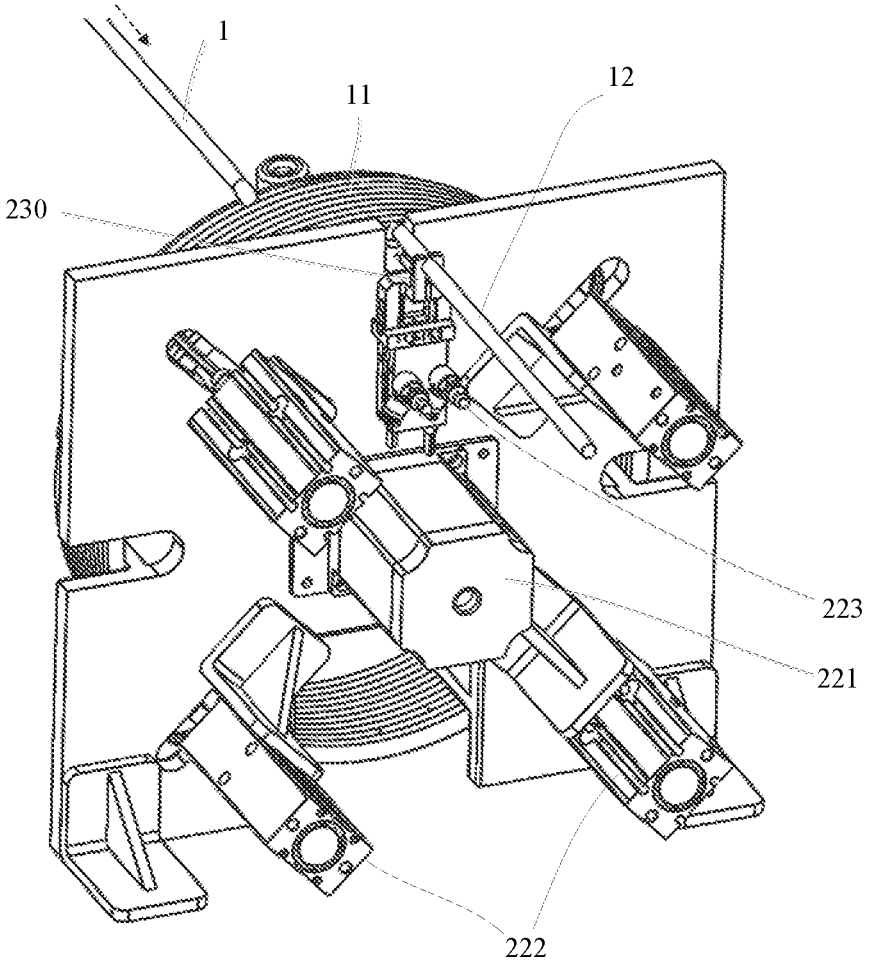
FIGS. 4A and 4B are schematic diagrams respectively showing a part of a cable coiling device according to an exemplary embodiment of the present disclosure.
Figure 4B:
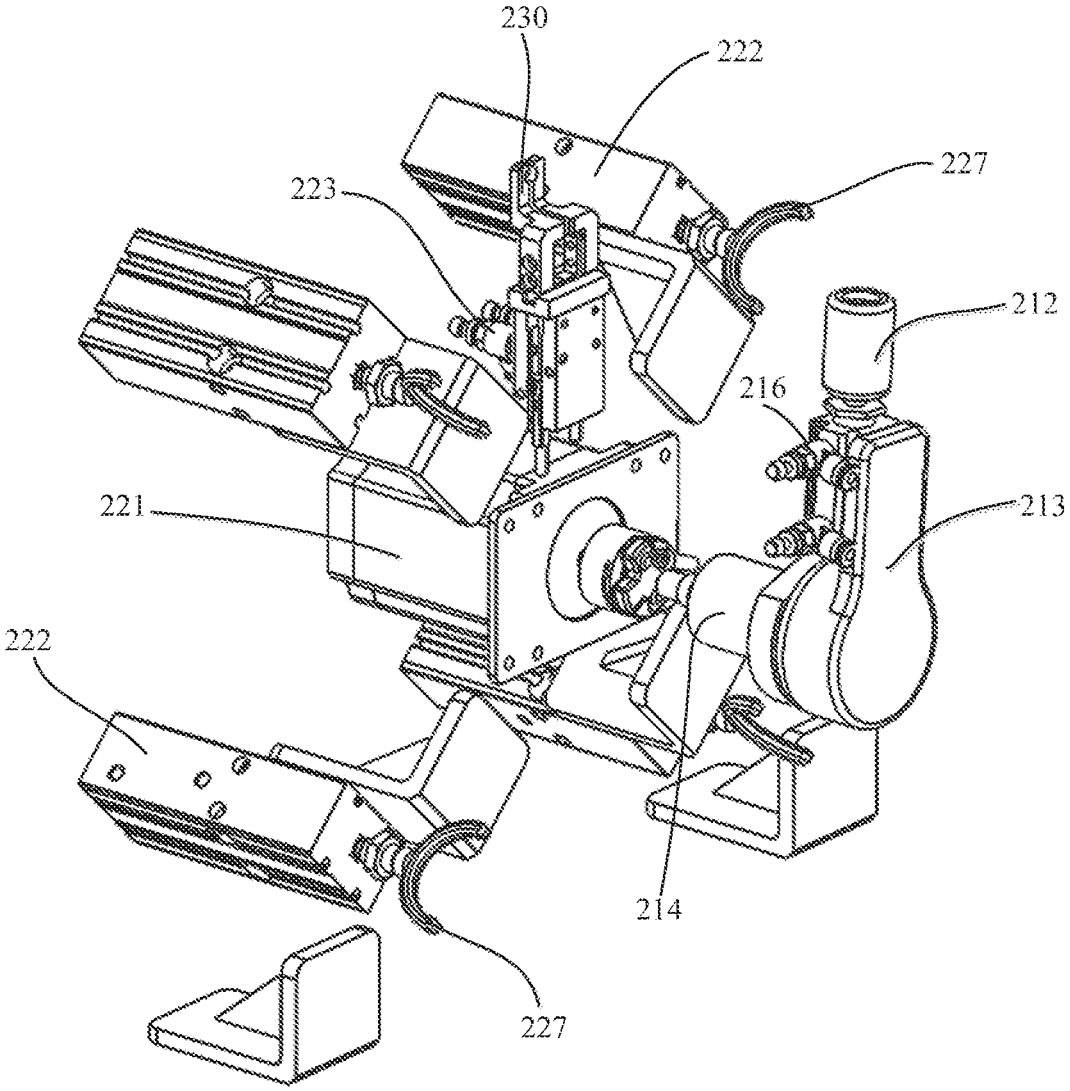

As shown in FIGS. 4A and 4B, the housing of the driving module 220 has been unloaded, and the driving module 220 also includes a second drive mechanism 223 configured to drive the cable clamping mechanism 230 to clamp the end segment 12 of the cable 1 before and during the coiling of the cable 1 by the cable coiling mechanism 210, and to drive the cable clamping mechanism 230 to release the end segment 12 during unloading the cable roll 11.

As shown in FIGS. 1 and 3A-3C, a notch 215 is formed on the outer circumference of the coiling disc 211, and the rolling wheel 212 is configured to coil the cable 1 on the outer circumference of the coiling disc 211 so as to push the fed cable 1 across over the notch 215 in the circumferential direction of the coiling disc 211 to form the cable roll 11. As described below, a bundling wire 301 for bundling the cable roll 11 passes through the notch 215 and bundles the cable roll 11 to prevent the cable roll 11 from loosening. In the illustrated embodiment, the notch 215 is formed at the bottom of the coiling disc 211, such as at a position radially opposite to the cable clamping mechanism 230. In other embodiments, the notch may be provided at any position on the coiling disc suitable for the bundling of the cable roll.

Figure 2:
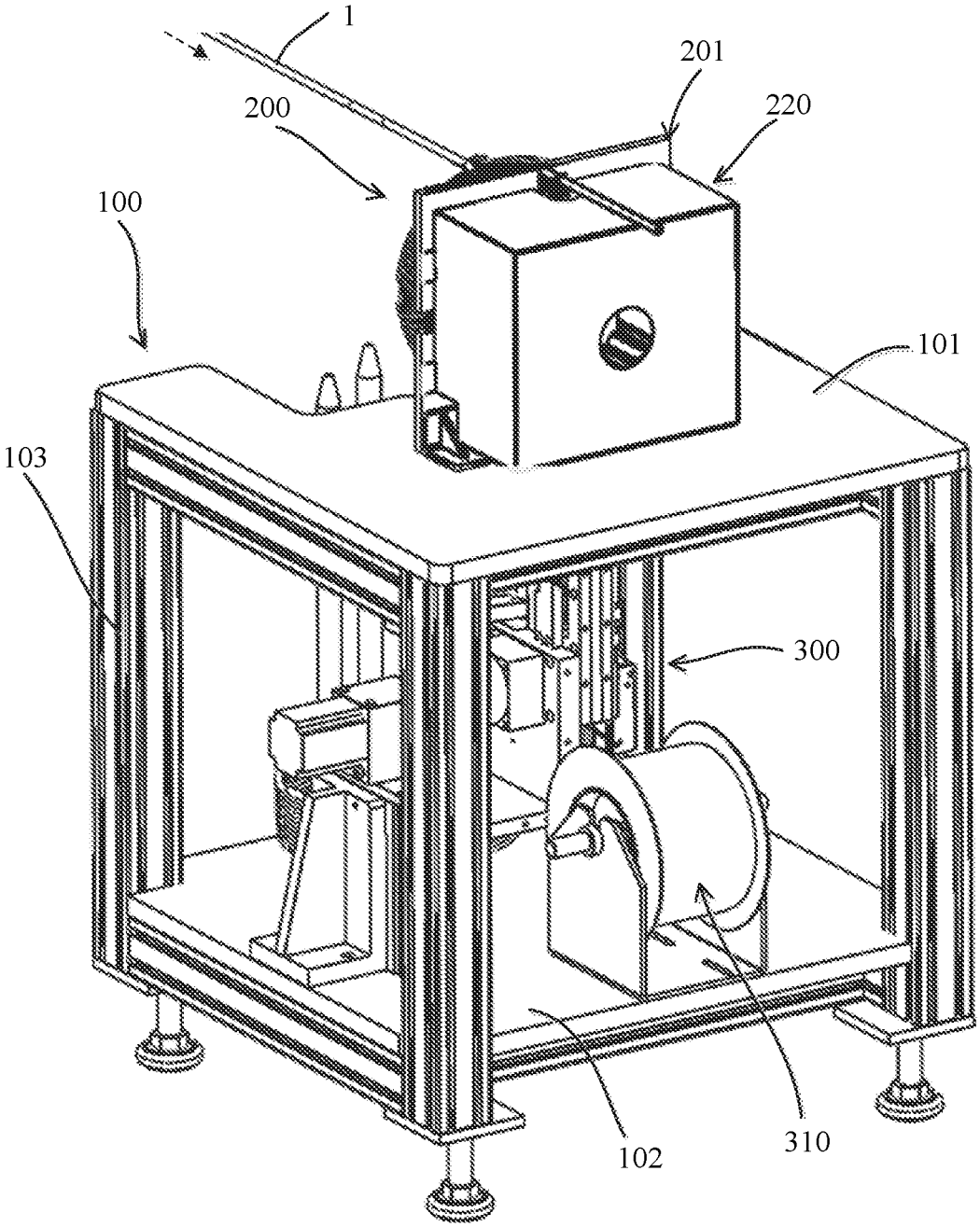
FIG. 2 is another perspective view schematically showing a cable processing system according to an exemplary embodiment of the present disclosure.

As shown in FIGS. 1 and 3A-3C, a plurality of grooves 217 spaced from each other are arranged on the outer circumference of the coiling disc 211 along the circumferential direction, and the cable coiling device 200 also includes an unloading mechanism 227. At least a part of each unloading mechanism 227 is positioned in the corresponding groove 217 and configured to unload the cable roll 11 from the outer circumference of the coiling disc 211, for example, push the cable roll 11 away from the coiling disc in the direction away from the partition plate 201. As shown in FIGS. 1 and 2, the unloaded cable roll 11 may be stored or sleeved on a receiving column 110, for example. As shown in FIG. 4B, the unloading mechanism 227 may be a C-shaped structure or a fork structure with two fingers.

As shown in FIGS. 4A and 4B, the driving module 220 also includes a third drive mechanism 222 for driving the unloading mechanism 227 to push the cable roll 11 outward from the coiling disc 211 to unloading the cable roll 11.

In some embodiments, as shown in FIGS. 1 and 3A-4A, a plurality of slots 207 may be formed on the spacer plate 201, and each slot 207 is aligned with the corresponding groove 217 so that one unloading mechanism 227 is at least partially accommodated in the slot 207 and the groove 217, so that the two prongs of the unloading mechanism 227 can be located on the radial inner and outer sides of the cable roll 11.

As shown in FIGS. 1-2 and 5A-5C, the cable processing system according to the present disclosure may also include a cable bundling device 300 configured to bundle the formed cable roll 11 with the bundling wire 301 from the spool 310. The support frame 100 includes an upper support plate 101 and a lower support plate 102 spaced from the upper support plate 101. The upper support plate 101 and the lower support plate 102 can be connected and supported by legs 103. The cable coiling device 200 is fixed on the upper support plate 101 and located on the upper surface of the upper support plate 101, while the cable bundling device 300 is installed on the lower support plate 102 and located below the upper support plate 101, and the spool 310 can also be provided on the lower support plate 102.

In the exemplary embodiment, the cable bundling device 300 can move upward in the vertical direction when it is necessary to bundle the cable roll 11, so that the bundling wire 301 at least partially winds around the cable roll 11 and bundles the cable roll 11. The cable bundling device 300 moves downward during coiling the cable 1 by the cable coiling device 200, so as not to interfere with the coiling of the cable. For example, a lifting device 350 fixed on the lower support plate 102 may be provided for lifting at least the components of the cable bundling device 300 for bundling the cable roll.

Figure 5A:
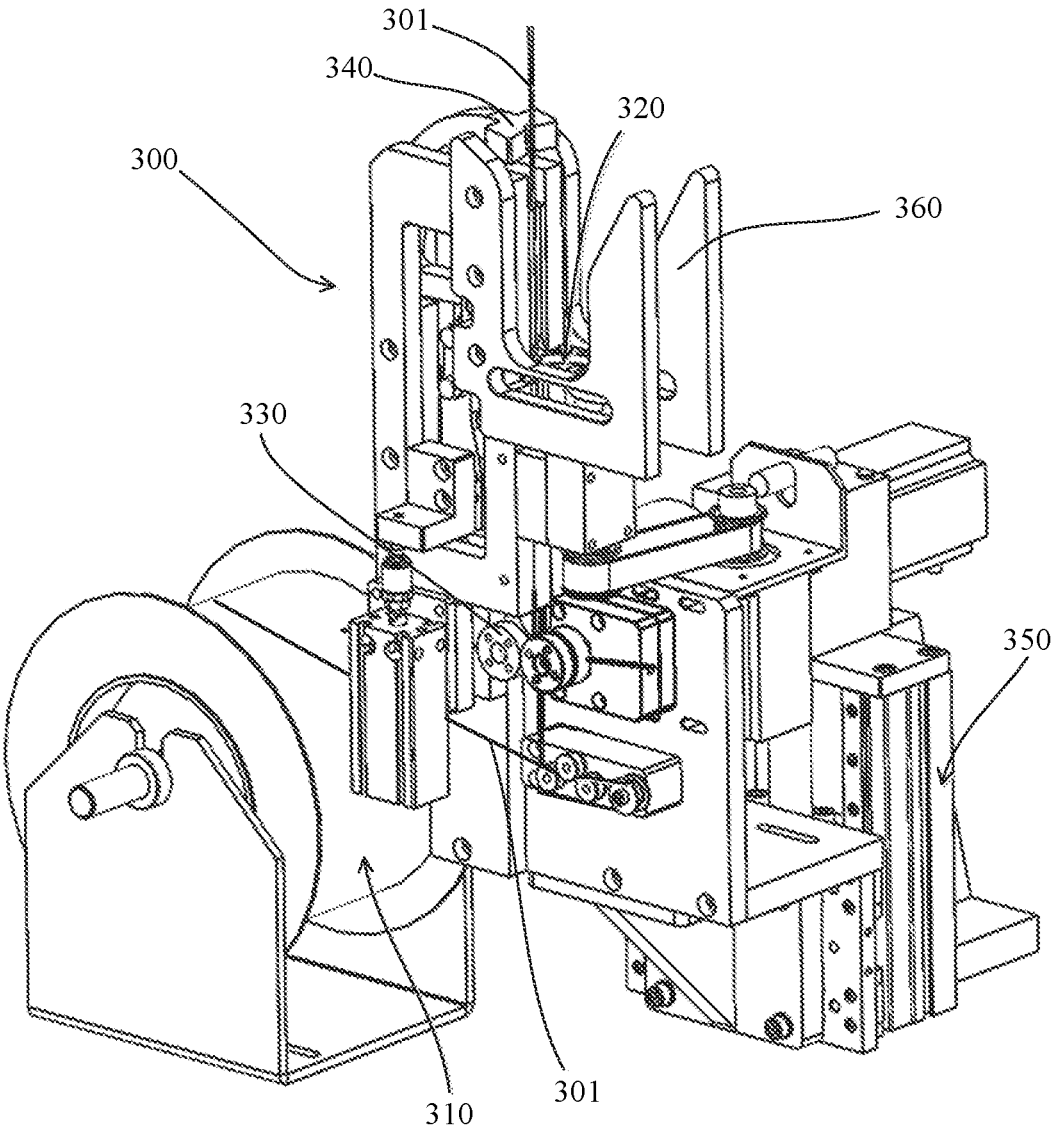
FIGS. 5A to 5C are schematic diagrams respectively showing a cable bundling device according to an exemplary embodiment of the present disclosure.
Figure 5B:
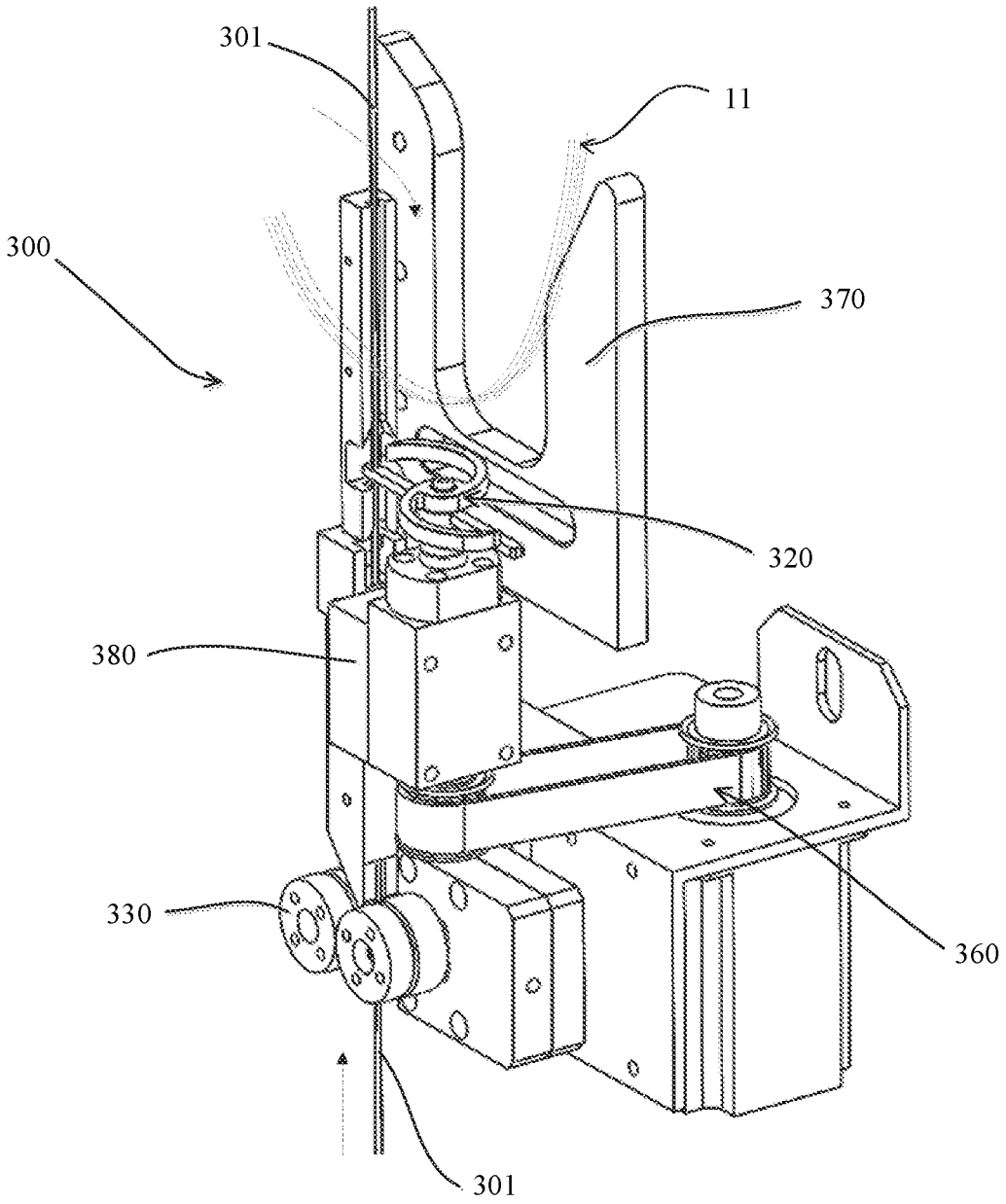
Figure 5C:
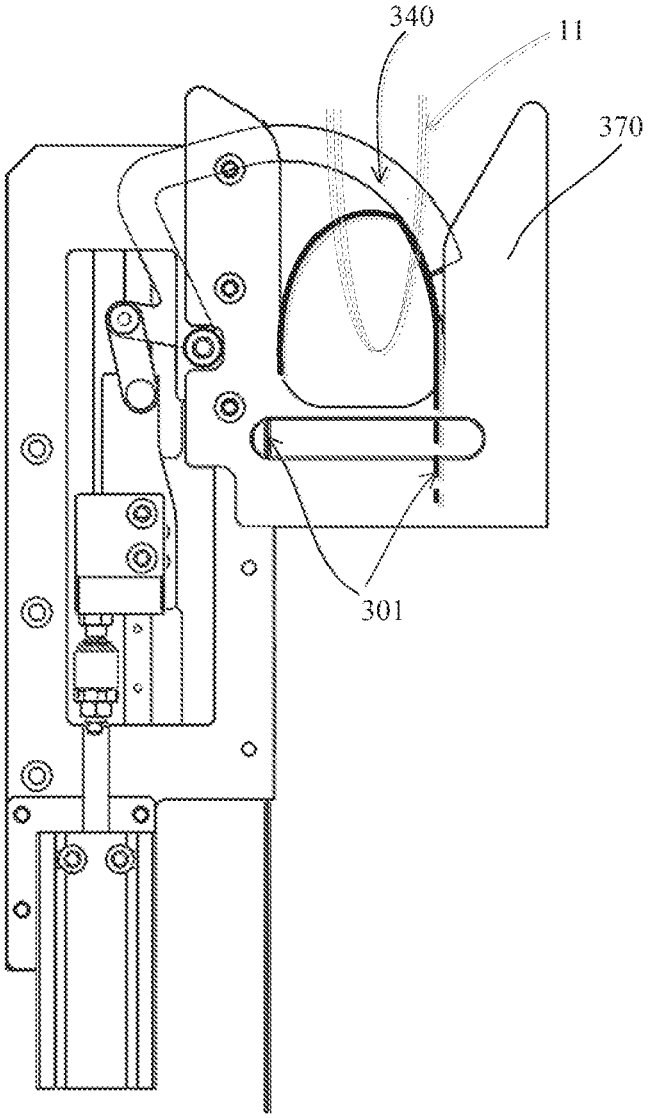

Referring to FIGS. 5A-5C, the cable bundling device 300 may include a wire twisting mechanism 320, which can be positioned below the cable coiling device 200 for twisting the opposite ends of the bundling wire 301 to bundle the cable roll 11 with the bundling wire 301. A driving device 360 may be provided to drive the wire twisting mechanism 320 to rotate to twist and wind the opposite ends of the wire 301. A wire feeding device 330, such as a feed roller, may be provided to feed the bundling wire 301 (e.g., upward) from the spool 310 to a position near the cable roll 11. A wire bending mechanism 340 can also be provided, which can be pivotally arranged above the wire twisting mechanism 320 to push the front end of the bundling wire 301 through the cable roll 11 and bend downward from the radial inner side of the cable roll 11 to the radial outer side of the cable roll 11, so that the front end of the bundling wire 301 is received and twisted by the wire twisting mechanism 320.

In the illustrated embodiment, the cable bundling device 300 may also be provided with a cable roll receiving structure 370, such as two spaced plates with U-shaped openings, which are used to receive at least the part of the cable roll 11 to be bundled. The wire twisting mechanism 320 may be located between the two plates. In addition, a cutter 380 may be provided between the wire feeding device 330 and the wire twisting mechanism 320 to cut the bundling wire after the wire feeding device 330 has fed a segment of bundling wire with sufficient length, so that the wire twisting mechanism 320 can twist and wind the front end of the bundling wire segment to bundle the cable roll 11.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A cable coiling device, comprising:

a cable coiling mechanism adapted to coil a cable to form a cable roll, including:

a coiling disc having an outer circumference defining a width in a feeding direction of the cable; and a rolling wheel driving the cable to rotate along a circumferential direction of the coiling disc while the cable is fed in the feeding direction and adapted to continuously coil the cable on the outer circumference of the coiling disc; and a cable clamping mechanism adapted to clamp and fix an end segment of the cable having a predetermined length during coiling of the cable, wherein the end segment is clamped for processing while the cable is coiled.

2. The cable coiling device according to claim 1, wherein the coiling disc is fixedly mounted to the device, and the rolling wheel is rotatable relative to the coiling disc.

3. The cable coiling device according to claim 2, wherein the rolling wheel rotates relative to the coiling disc along the circumferential direction of the coiling disc.

4. The cable coiling device according to claim 3, wherein the cable clamping mechanism is fixedly provided relative to the coiling disc.

5. The cable coiling device according to claim 3, wherein the rolling wheel contacts the cable and rotates around an axis extending in a radial direction of the coiling disc during coiling the cable by the cable coiling mechanism.

6. The cable coiling device according to claim 3, wherein the rolling wheel is extendable and retractable in the radial direction of the coiling disc.

7. The cable coiling device according to claim 6, wherein the rolling wheel is extended out to contact with the cable while the cable is coiled by the cable coiling mechanism.

8. The cable coiling device according to claim 7, wherein the rolling wheel is retracted back to separate from the cable roll while the cable roll is unloaded from the coiling disc.

9. The cable coiling device according to claim 3, wherein the cable coiling mechanism further comprises a coiling arm, the rolling wheel is mounted on one end of the coiling arm, and the other end of the coiling arm opposite to the one end is connected with a rotation shaft extending through the coiling disc in the feeding direction.

10. The cable coiling device according to claim 9, wherein when the rotation shaft is rotated, the rotation shaft drives the coiling arm and the rolling wheel installed on the coiling arm to rotate relative to the coiling disc along the circumferential direction of the coiling disc.

11. The cable coiling device according to claim 9, further comprising a first driving mechanism configured to drive the rotation shaft to rotate, so as to drive the coiling arm and the rolling wheel to rotate relative to the coiling disc along the circumferential direction of the coiling disc.

12. The cable coiling device according to claim 3, wherein a notch is formed on the outer circumference of the coiling disc, and the cable coiled on the outer circumference of the coiling disc crosses over the notch, the coiled cable is bundled by a bundling wire passing through the notch to form a cable roll.

13. The cable coiling device according to claim 3, wherein:

a plurality of grooves are formed on the outer circumference of the coiling disc and spaced from each other along the circumferential direction; and the cable coiling device also includes an unloading mechanism, at least a part of the unloading mechanism is positioned in the groove and is configured to unload the coiled cable roll from the outer circumference of the coiling disc.

14. The cable coiling device according to claim 1, wherein the cable coiling device further comprises a spacer plate, and the cable clamping mechanism and the cable coiling mechanism are arranged on respective opposite sides of the spacer plate.

15. The cable coiling device according to claim 1, further comprising a second driving mechanism driving the cable clamping mechanism to clamp the cable before and during coiling the cable, and driving the cable clamping mechanism to release the cable during unloading the coiled cable roll.

16. A cable processing system, comprising:

a support frame including an upper support plate and a lower support plate spaced from the upper support plate;

a cable coiling device mounted on the upper support plate of the support frame, including:

a cable coiling mechanism coiling a cable to form a cable roll; and a cable clamping mechanism clamping and fixing an end segment of the cable having a predetermined length during coiling of the cable, the end segment is clamped for processing while the cable is coiled; and a cable bundling device installed on the lower support plate in a manner movable in a vertical direction, the cable bundling device adapted to bundle the coiled cable with a bundling wire from a spool to form a cable roll.

17. A cable coiling device, comprising:

a cable coiling mechanism adapted to coil a cable to form a cable roll and including a coiling disc having an outer circumference defining a width in a feeding direction of the cable, the cable continuously coiled on the outer circumference of the coiling disc, wherein a notch is formed on the outer circumference of the coiling disc, and the cable coiled on the outer circumference of the coiling disc crosses over the notch, the coiled cable is bundled by a bundling wire passing through the notch to form a cable roll; and a cable clamping mechanism adapted to clamp and fix an end segment of the cable having a predetermined length during coiling of the cable, wherein the end segment is clamped for processing while the cable is coiled.

18. The cable coiling device according to claim 17, wherein the coiling disc is fixedly mounted to the device.

19. The cable coiling device according to claim 17, wherein:

a plurality of grooves are formed on the outer circumference of the coiling disc and spaced from each other along the circumferential direction; and the cable coiling device further includes an unloading mechanism, at least a part of the unloading mechanism is positioned in the groove and is adapted to unload the coiled cable roll from the outer circumference of the coiling disc.

20. A cable coiling device, comprising:

a cable coiling mechanism adapted to coil a cable to form a cable roll and including:

a coiling disc having an outer circumference defining a width in a feeding direction of the cable, the cable continuously coiled on the outer circumference of the coiling disc, a plurality of grooves are formed on the outer circumference of the coiling disc and spaced from each other along the circumferential direction; and an unloading mechanism, at least a part of the unloading mechanism is positioned in the groove and is adapted to unload the coiled cable roll from the outer circumference of the coiling disc; and a cable clamping mechanism adapted to clamp and fix an end segment of the cable having a predetermined length during coiling of the cable, wherein the end segment is clamped for processing while the cable is coiled.

* * * * *